United States Patent [19]

Potts

[11] 4,065,025

[45] Dec. 27, 1977

[54] EASY OPENING CAN END WITH PUSH-IN TABS

[75] Inventor: Vinson S. Potts, Cherry Hill, N.J.

[73] Assignee: Crown Cork & Seal Company, Inc., Philadelphia, Pa.

[21] Appl. No.: 701,623

[22] Filed: July 1, 1976

Related U.S. Application Data

[63] Continuation-in-part of Ser. No. 637,867, Dec. 4, 1975, abandoned, and a continuation-in-part of Ser. No. 596,530, July 16, 1975, abandoned.

[51] Int. Cl.[2] ..... B65D 51/22

[52] U.S. Cl. ..... 220/258; 220/265; 220/269; 220/334; 220/259

[58] Field of Search ..... 220/260, 265, 266, 258, 220/268, 269, 273, 334, 259, 339, 359, 337; 229/7 R; 222/541

[56] References Cited

U.S. PATENT DOCUMENTS

| | | | |
|---|---|---|---|
| 2,147,004 | 2/1939 | Wark et al. | 220/258 |
| 3,261,497 | 7/1966 | Lipske | 220/265 |
| 3,362,569 | 1/1968 | Geiger | 220/268 |
| 3,910,453 | 10/1975 | Kneusel et al. | 220/334 |

*Primary Examiner*—George T. Hall

*Attorney, Agent, or Firm*—Woodcock, Washburn, Kurtz & Mackiewicz

[57] ABSTRACT

A can end of the easy opening type comprises an end panel having a preformed dispensing opening and a push tab member having an integrally formed rivet for attachment to the end panel. In one embodiment, the end panel includes a peninsular hinge portion having a rivet receiving opening therein such that all deformation during opening is substantially limited to the hinge portion rather than the push-tab member. In another embodiment, an actuator opening is located between the dispensing opening and the rivet receiving opening of the end panel so as to permit a finger engageable protuberance on the push-tab member to extend therethrough.

56 Claims, 8 Drawing Figures

Fig. 6
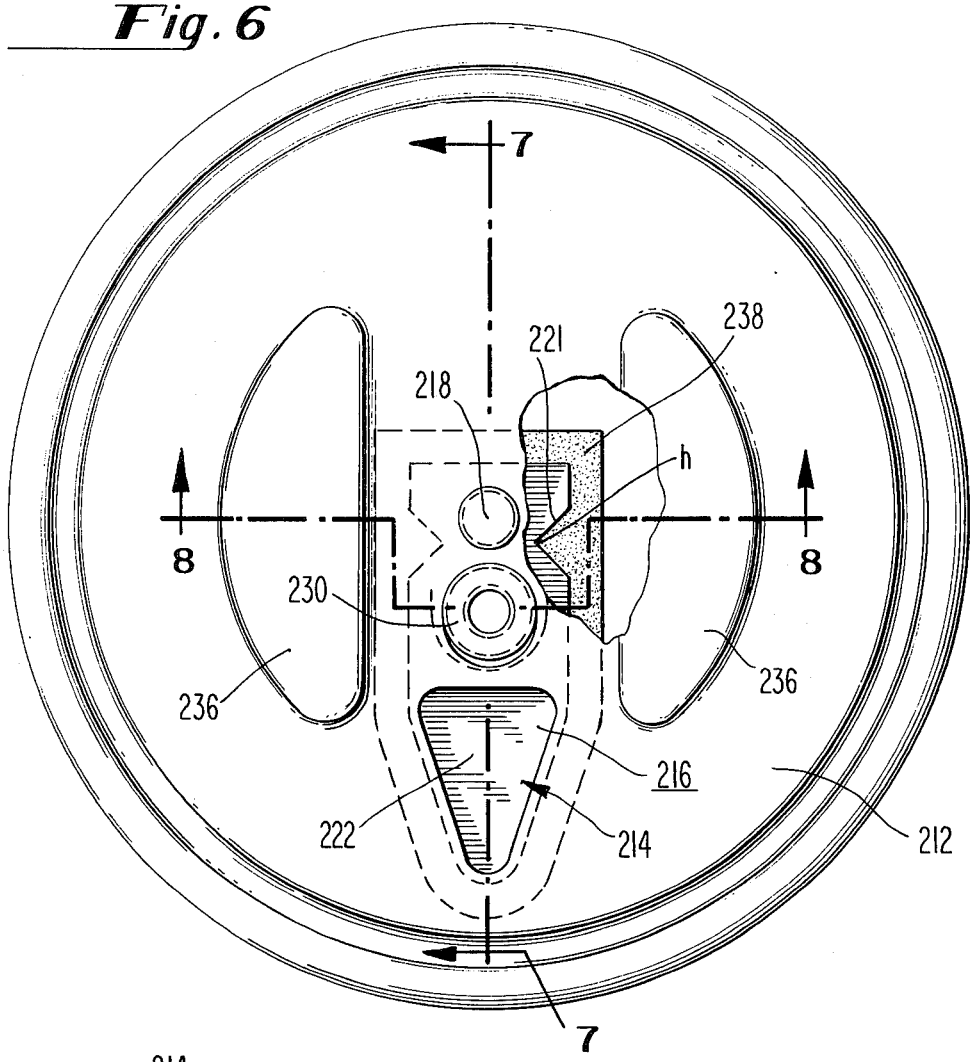
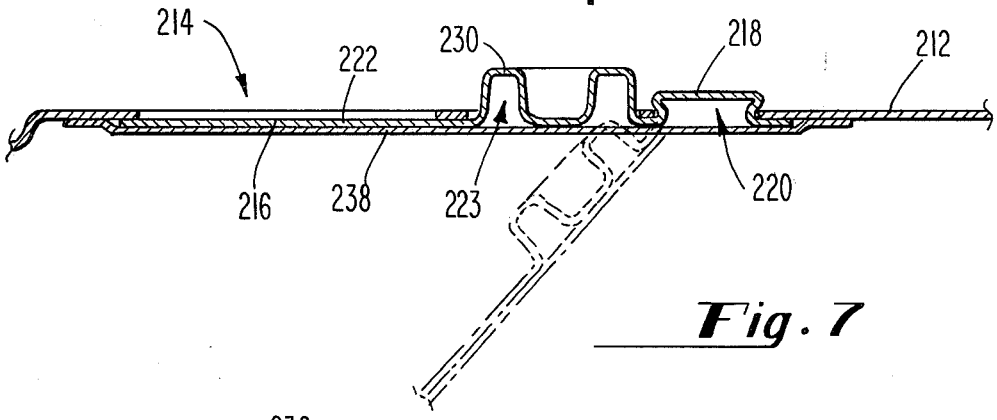
Fig. 7
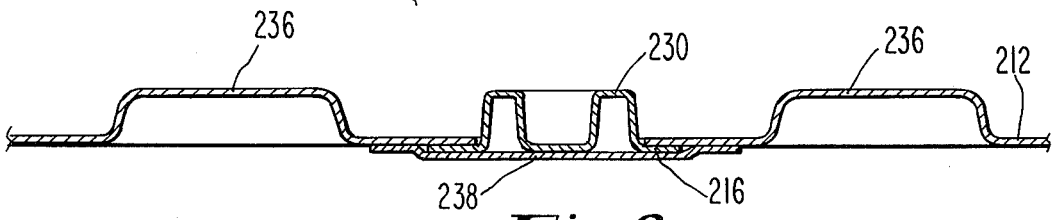
Fig. 8

EASY OPENING CAN END WITH PUSH-IN TABS

RELATED APPLICATIONS

This is a continuation-in-part of application Ser. No. 637,867 filed Dec. 4, 1975, now abandoned and a continuation-in-part of application Ser. No. 596,530 filed July 16, 1975, now abandoned.

BACKGROUND OF THE INVENTION

This invention relates to easy opening containers or cans which may be opened by hand without benefit of an opening tool.

To date, the most commercially successful easy opening cans utilize a tab which is formed by scoring the can end panel and removed by grasping a ring attached thereto and ripping out the tab from the end panel along the score lines. Aluminum is usually utilized for a ring-tab ends of this type because its soft and malleable qualities which allow the use of substantial residual scoring depths while still permitting removal of the tab by hand.

However, aluminum can ends are objectionable from a number of standpoints. Aluminum is expensive and of relatively low strength as compared with a metal such as steel so that large quantities of aluminum must be utilized to provide can ends of sufficient gauge to withstand internal pressures generated within the cans. In addition, aluminum is expensive relative to steel, and aluminum can ends are also undesirable as compared with steel from an ecological standpoint since aluminum is not readily degradable. Furthermore, aluminum can ends are often utilized with steel can bodies and this combination is undesirable since an electrochemical reaction may be set up within the can due to its dual metallic nature, thereby creating the risk that the contents within a container may become contaminated or, at a minimum, the taste of those contents may be affected.

As a result, a good deal of emphasis has been placed of late on easy opening can designs which may utilize any metal including steel.

U.S. Pat. No. 3,871,550 — Chiappe discloses an easy opening can end having a preformed or pre-cut dispensing opening which is sealed closed by a plastic closure member bonded or otherwise attached to one side of the dispensing opening. The closure member or tab includes an outwardly extending protuberance for engagement by the fingers during opening.

In an easy opening can end of this type, the design must achieve several important functions. First, the means of attaching the closure member must assure that the closure member remains in place. Second, the hinge associated with the closure member should have a memory so as to permit the closure member to remain in the open position during dispensing. Third, means must be provided to permit the push-in closure member to be open all the way without requiring the opener's fingers to be inserted into the container. And fourth, the closure member must be capable of being pushed in with relative ease.

SUMMARY OF THE INVENTION

It is an overall object of this invention to provide an easy opening can end with an improved push-in tab member.

It is a more specific object of this invention to provide easy opening can ends with an improved push-in tab member which is securely attached to the can end panel.

In accordance with these and other objects of the invention, a preferred embodiment of the invention comprises a can end of the easy opening type comprising an end panel having a preformed dispensing opening and a rivet receiving opening. The tab which is adapted to be pushed inwardly includes a rivet which is received by the rivet receiving opening and a closure portion closes the dispensing opening on the interior side thereof.

It is another specific object of this invention to provide a tab having a memory which permits the tab to remain in the open position after opening.

It is a further specific object of this invention to provide a tab which may be opened with relative ease.

In accordance with these specific objects of this invention, the end panel includes a peninsular hinge portion extending into the dispensing opening with the rivet opening being located in the peninsular portion. The peninsular portion is adapted to form a hinge when the tab is pushed inwardly during opening without any substantial deformation of the tab. In a preferred embodiment of the invention, the peninsular portion includes an indentation to provide additional strength. This preferred embodiment also comprises a plastic tab which is located within a recess of the end panel which protrudes outwardly. A tape-like sealing means then extends across the tab within the recess to the end panel at the periphery of the recess.

In accordance with another specific object of the invention, tab may be opened without requiring the fingers to be inserted into the container.

In accordance with this object of the invention, the tab comprises an actuating portion more centrally located on the end panel than the center of the closure portion and the hinge portion is more centrally located than the actuating portion. In one embodiment, an actuating opening separate and distinct from the dispensing opening is provided.

BRIEF DESCRIPTION OF THE DRAWINGS

FIG. 6 is a plan view of a further embodiment of the invention;

FIG. 7 is a fragmentary sectional view of the embodiment of FIG. 6 taken along line 7—7; and FIG. 8 is a fragmentary sectional view of the embodiment of FIG. 6 taken along line 8—8.

DETAILED DESCRIPTION OF THE PREFERRED EMBODIMENTS

Figure 1:
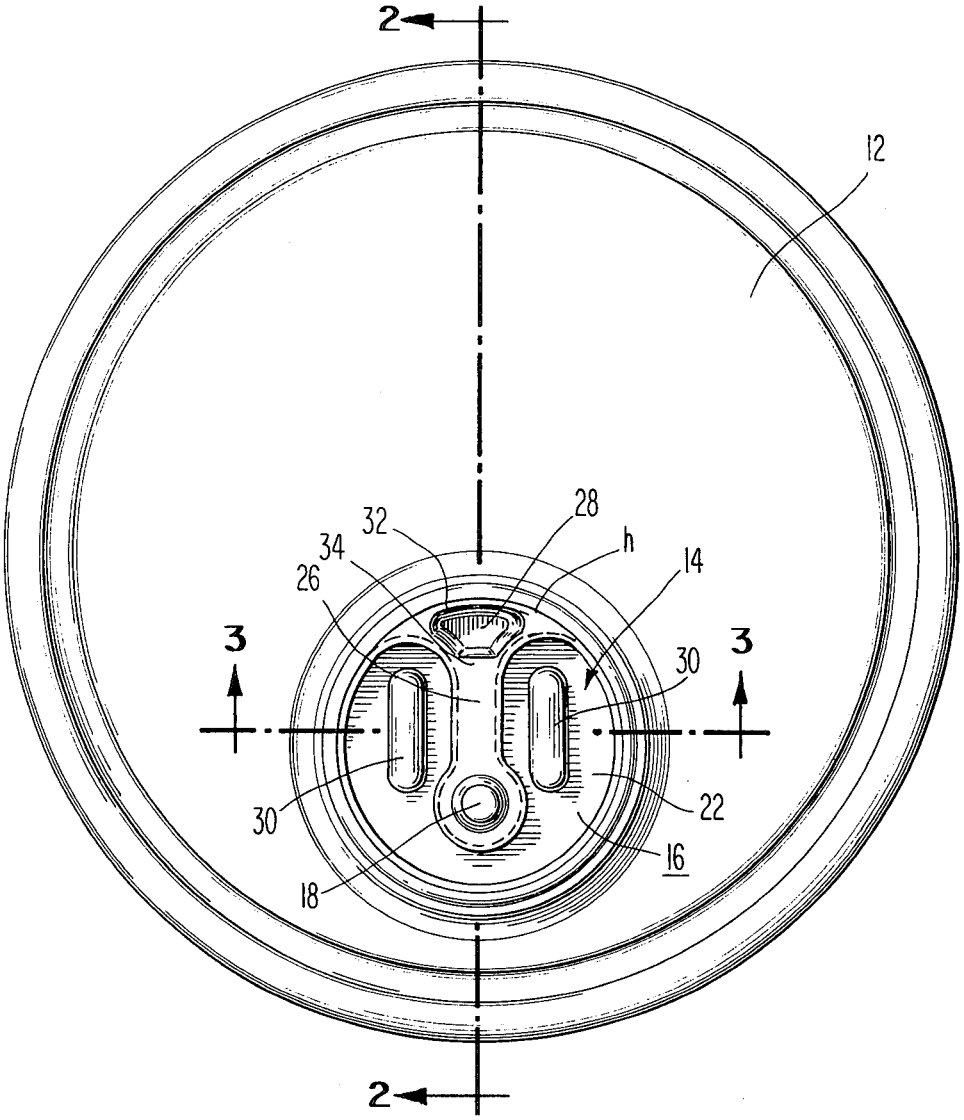
FIG. 1 is a plan view of a preferred embodiment of the invention.
Figure 3:
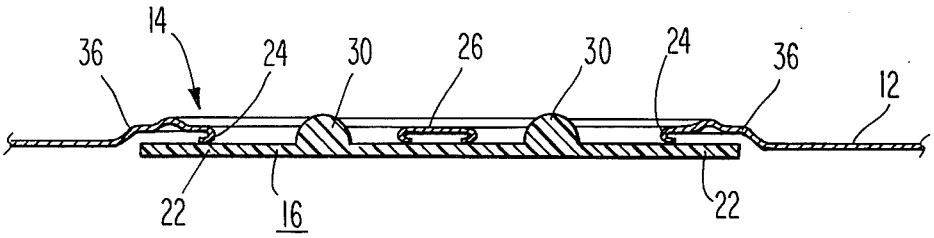
FIG. 3 is a fragmentary sectional view of the embodiment of FIG. 1 taken along line 3—3.
Figure 2:
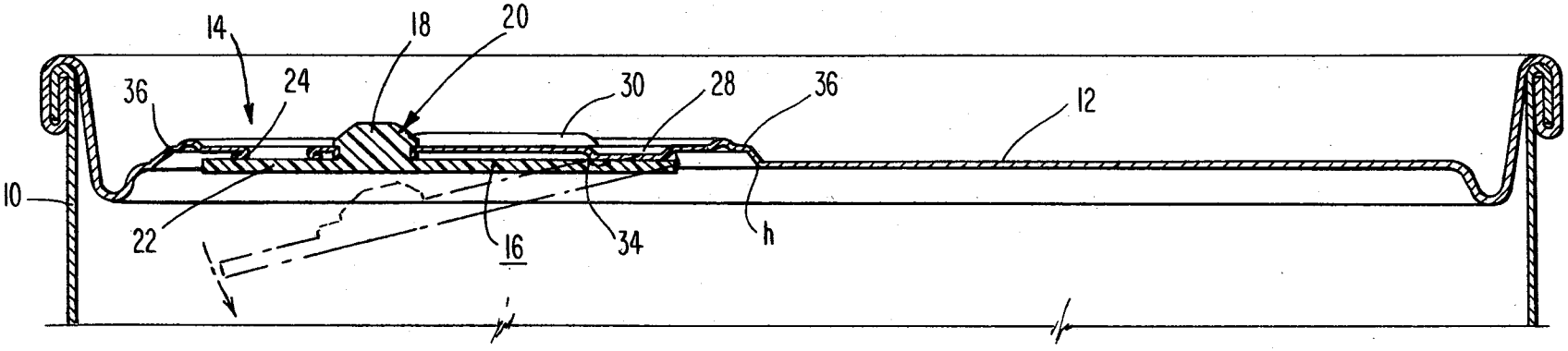
FIG. 2 is a full sectional view of the embodiment of FIG. 1 taken along line 2—2.

As shown in FIGS. 1-3 a can of the easy opening type comprises a can body 10 and an end panel 12 double seamed to the top of the can body 10 in a conventional manner. The panel 12 includes a preformed dispensing opening 14.

In accordance with this invention, the dispensing opening 14 is sealed closed by a push tab member 16 which is secured to the interior side of the end panel 14. The tab comprises an integrally formed rivet 18 which extends outwardly through a rivet receiving opening 20 of the end panel 12. The tab further comprises a closure portion 22 which extends outwardly beyond the periphery of the dispensing opening which is formed by a downwardly and radially outwardly extending curl 24 which prevents the cutting of the fingers during opening. An adhesive not shown is located between the edges of the tab 16 and the curl 24 so at to form a seal between the contents within the interior of the can and the dispensing opening 14.

In accordance with one important aspect of the invention, the end panel includes a peninsular hinge portion 26 which extends into the dispensing opening 14. The peninsular portion 26 which includes the rivet receiving opening 20 is adapted to be deformed inwardly when the push tab member 16 is pushed inwardly during opening as shown in broken lines in FIG. 2. The hinged portion 26 is further adapted to bend along a predetermined hinged line *h* extending along an indented area 28 which provides additional strength so as to prevent any substantial deformation of the push tab member 16 in the peninsular portion 26.

In accordance with another important aspect of the invention, the push tab member 16 comprises an actuating portion 30 in addition to a closure postion 22 which covers the dispensing opening 14 and the hinge portion 34 located adjacent the indented area 28. The actuating portion 30 protrudes outwardly through the dispensing opening 14 so as to permit finger engagement and opening to the position shown in dotted lines in FIG. 2 without substantial extension of the fingers into the dispensing opening 14. Furthermore, the actuating portion 30 is more centrally located on the end panel than the center of the closure portion 22 and the hinge portion at line *h* is more centrally located than the actuating portion 30 so as to provide a mechanical advantage which assists in establishing a full open position of the push tab member as shown in FIG. 2 without extending the fingers substantially into the interior of the can.

Push tab member 16 as shown in the embodiments of FIG. 1 comprises a plastic of substantial thickness. The thickness of the plastic tab 16 is accommodated by forming the end panel with an outward protrusion or recess 36 in the area of the dispensing opening 14 which receives the plastic push tab 16. Suitable plastic materials include polypropylene, polyethylene, polyesters, nylons or other similar materials.

Figure 5:
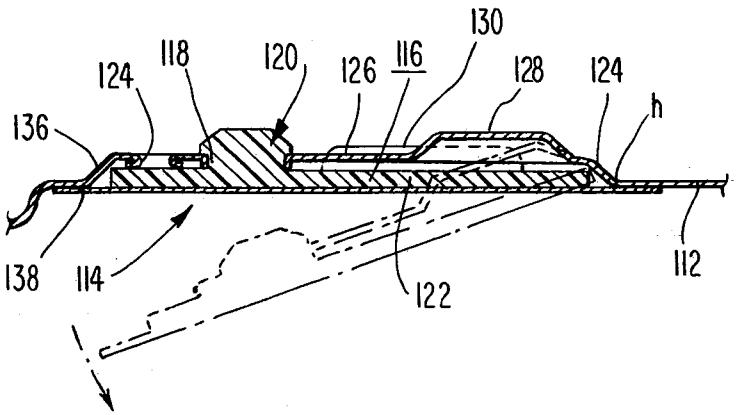
FIG. 5 is a sectional view of the embodiment of FIG. 4 taken along line 5—5.
Figure 4:
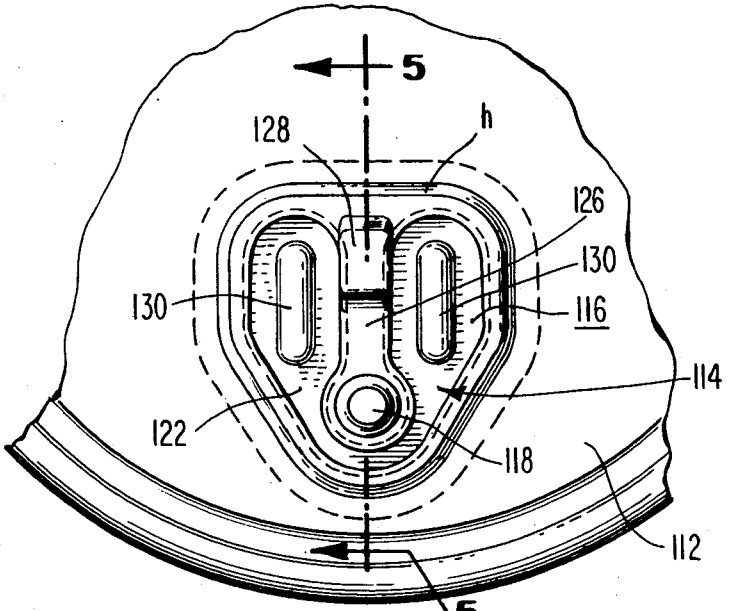
FIG. 4 is a fragmentary plan view of another embodiment of the invention.

The embodiment of FIGS. 4 and 5 is substantially identical to the embodiment of FIGS. 1–3 except for the shape of the push-in tab member and the means by which the seal is achieved between the tab member and the end panel. For this reason, the same reference characters preceded by the numberals 1 are used to describe elements which perform the same functions with the same or substantially the same means.

As shown in FIG. 4, the dispensing opening 114 as well as the tab 116 are somewhat elongated as compared with the substantially circular tab and dispensing opening in the embodiment of FIGS. 1–3. As shown in FIG. 5, the seal between the elongated tab member 116 and the interior side of the end panel 112 is achieved by a tape-like member 138 which extends completely across the recess 136 so as to form a seal outwardly of the dispensing opening as well as the recess 136. A suitable tape-like member includes PSDX 46 or 49 or Y-8023 manufactured by the 3M Company or similar type manufactured by other companies. (CC-74). As also shown in FIG. 5, the indented area 128 extends upwardly above the hinge portion at line *h* of the tab 116 rather than downwardly as shown in the embodiments of FIGS. 1–3.

In the embodiment of FIGS. 6–8, an end panel 212 comprises a dispensing opening 214 which is closed by a push-tab member 216. The tab member 216 is attached to a central portion of the end panel 212 by a rivet 218 which is integrally formed with the tab member 216 and extends through a centrally located rivet receiving opening 220. In this embodiment of the invention, the tab 216 bends along a bend line *h* which is established by indentations 221 in the sides of the tab 216.

The tab 216 comprises a closure portion 222 which covers the dispensing opening 214. In order to achieve a seal between the end panel 212 and the tab 216, a flexible tapelike member 238 is provided which extends across the tab 216 into sealing engagement with the end panel 212.

In accordance with one important aspect of this invention, the panel 212 includes an additional opening 223 which receives an actuator 230 more centrally located than the dispensing opening 214 or the closure portion 222 of the tab 216. The actuator 230 allows the tab 216 to be pushed downwardly into the container a substantial distance at the opening 214 without inserting a finger into the container. It will be noted that the panel 212 includes raised portions 236 on both sides of the tab member 216 so as to prevent accidental actuation of the tab 216 by the placing of an object on top of the end panel 212.

The can ends disclosed in the foregoing embodiments may of course comprise steel since there is no scoring or weakening of the can ends. However, it is not necessary that the end comprise steel and other alternatives including aluminum are suitable. In addition, specific materials have been suggested for use in the closure tabs. However, other materials may be utilized.

Various features of the invention are incorporated in the various embodiments disclosed in the aforesaid application Ser. No. 596,530. Accordingly, all of the embodiments of the invention disclosed in application Ser. No. 596,530 are incorporated herein by reference as if set forth in full.

It will therefore be understood that although specific embodiments of the invention have been shown and described and various modifications suggested, other embodiments and modifications will occur to those of ordinary skill in the art and will of course fall within the true spirit and scope of the invention as set forth in the appended claims.

What is claimed is:

1. A can end of the easy opening type comprising:

an end panel having a preformed dispensing opening therein and a rivet receiving opening; and a tab adapated to be pushed inwardly including a rivet extending through said rivet receiving opening to the exterior side of said end panel, said tab including a closure portion closing said dispensing opening on the interior side of said end panel.

2. The can end of claim 1 wherein said end panel includes a peninsular hinge portion extending into said dispensing opening, said peninsular portion including said rivet receiving opening and being deformed inwardly when said tab member is pushed inwardly during opening.

3. The can end of claim 2 wherein said peninsular hinge portion is adapted to be substantially deformed without any substantial deformation of said tab.

4. The can end of claim 3 wherein said peninsular hinge portion is adapted to bend along a predetermined hinge line.

5. The can end of claim 2 wherein said tab comprises plastic.

6. The can end of claim 5 further comprising sealing means extending between said tab and the interior side of said end panel.

7. The can end of claim 6 wherein said tab comprises a protuberance extending outwardly through said dispensing opening to assist in opening.

8. The can end of claim 1 wherein said dispensing opening is spaced from said rivet receiving opening.

9. The can end of claim 1 wherein said rivet receiving opening is spaced from and more centrally located than said dispensing opening.

10. The can end of claim 1 wherein said tab includes a projection extending upwardly into said dispensing opening.

11. The can end of claim 1 wherein said end panel comprises a downwardly extending curl at the edge of said dispensing opening, said tab engaging said curl.

12. The can end of claim 1 wherein said end panel comprises a downwardly and radially outwardly extending curl at the edge of said dispensing opening, said tab engaging said curl.

13. The can end of claim 1 wherein said end panel protrudes outwardly at said dispensing opening and said rivet receiving opening on the exterior side of said panel so as to form a recess receiving said tab.

14. The can end of claim 13 wherein said end panel comprises a curl at the edge of said dispensing opening including a downwardly extending portion.

15. The can end of claim 14 wherein said curl includes a downwardly and outwardly extending portion, said tab engaging said outwardly extending portion.

16. The can end of claim 13 wherein said tab includes a tab portion located within said recess and a sealing portion extending from said tab portion to said end panel.

17. The can end of claim 16 wherein said sealing portion comprises a tape-like member.

18. The can end of claim 17 wherein said tab portion comprises plastic.

19. The can end of claim 1 wherein said tab includes a tab portion and a sealing portion.

20. The can end of claim 19 wherein said sealing portion comprises a tape-like member extending between said tab portion and said end panel on the interior side of said end panel.

21. The can end of claim 20 wherein said tape-like member extends across the interior side of said tab portion to the interior side of said end panel.

22. The can end of claim 20 wherein said tab portion comprises plastic.

23. The can end of claim 20 wherein said tab portion comprises metal.

24. The can end of claim 1 wherein said end panel comprises an actuating opening, said tab including an actuating portion extending outwardly to said exterior side of said end panel through said actuating opening.

25. The can end of claim 24 wherein said actuating opening is located between said dispensing opening and said rivet receiving opening.

26. The can end of claim 25 wherein said tab is adapted to be bent so as to form a hinge between said actuating portion and said rivet when said tab is pushed inwardly.

27. The can end of claim 26 wherein said end panel includes a pair of raised portions on opposite sides of said actuating opening so as to guard against accidental opening.

28. The can end of claim 24 wherein said end panel includes a raised portion adjacent said actuating opening so as to guard against accidental opening.

29. The can end of claim 1 wherein said tab is adapted to be bent so as to form a hinge when said tab is pushed inwardly.

30. The can end of claim 1 wherein said rivet is integrally formed with said tab.

31. A can end of the easy-opening type comprising:
an end panel having a preformed dispensing opening and a separate opening spaced therefrom; and
a tab closing said dispensing opening and adapted to be pushed inwardly so as to open said dispensing opening, said tab including a fastening portion extending through said separate opening which fastening portion is rigidly attached to said end panel before and after said tab is pushed inwardly.

32. The can end of claim 31 wherein said tab includes a projection extending upwardly into said dispensing opening for use in pushing said tab inwardly.

33. The can end of claim 31 wherein said end panel comprises a downwardly extending curl at the edge of the dispensing opening.

34. The can end of claim 31 wherein said end panel comprises a downwardly and radially outwardly extending curl at the edge of said dispensing opening.

35. The can end of claim 31 wherein said end panel protrudes outwardly at said dispensing opening and said separate opening so as to form a recess in which said tab is located when said dispensing opening is closed.

36. The can end of claim 31 wherein said tab includes a tab portion and a sealing portion extending from said tab portion to said end panel.

37. The can end of claim 36 wherein said sealing portion comprises a tape-like member.

38. A can end of the easy opening type comprising:
an end panel having a dispensing opening therein and a rivet receiving opening, said end panel including a peninsular hinge portion extending into said dispensing opening and having said rivet receiving opening in said peninsular hinge portion; and
a tab attached to said hinge portion and sealingly covering said dispensing opening, said tab adapted to be pushed inwardly as to bend said hinge portion of said end panel during opening.

39. The can end of claim 38 wherein said peninsular portion is adapted to be substantially deformed without any substantial deformation of said tab.

40. The can end of claim 38 wherein said peninsular portion is adapted to bend along a predetermined hinged line.

41. The can end of claim 38 wherein said tab comprises plastic.

42. The can end of claim 41 wherein said tab comprises a pair of protuberances extending outwardly on opposite sides of said peninsular portion to assist in opening.

43. The can end of claim 38 wherein said end panel protrudes outwardly in the area of said dispensing opening so as to form a recess receiving said member.

44. The can end of claim 43 further comprising tape-like sealing means extending across said tab member in said recess to said end panel at the periphery of said recess.

45. A can end of the easy opening type comprising:

an end panel having a dispensing opening located between the center and the periphery of said end panel; and a tab attached to said end panel including a closure portion, an actuating portion and a fastening portion, said closure portion covering said dispensing opening, said actuating portion protruding outwardly so as to readily permit finger engagement, and said fastening portion being rigidly attached to said end panel, said actuating portion being more centrally located on said end panel than the center of said closure portion of said dispensing opening and said fastening portion being more centrally located than said actuating portion.

46. The can end of claim 45 wherein said tab comprises plastic.

47. The can end of claim 45 wherein said tab comprises metal.

48. The can end of claim 47 wherein said end panel comprises an actuating opening more centrally located than said dispensing opening, said actuating portion extending through said actuating opening.

49. The can end of claim 48 wherein said end panel includes a rivet receiving opening and said fastening portion comprises a rivet adapted to extend through said rivet receiving opening.

50. A can end of the easy opening type comprising:

an end panel having a dispensing opening and an actuating opening; and a tab attached to said panel including a closure portion, an actuating portion and a fastening portion, said closure portion covering said dispensing opening and said actuating portion extending outwardly through said actuating opening so as to readily permit finger engagement, said fastening portion being rigidly attached to said end panel.

51. The can end of claim 50 wherein said end panel includes a raised portion adjacent said actuating opening so as to guard against accidental opening.

52. The can end of claim 50 wherein said end panel includes a pair of raised portions on opposite sides of said actuating opening so as to guard against accidental opening.

53. The can end of claim 50 wherein said tab comprises a tab portion and a sealing portion.

54. The can end of claim 53 wherein said sealing portion comprises a tape-like member extending between said tab portion and said end panel on the interior side of said end panel.

55. The can end of claim 54 wherein said tape-like member extends across the interior side of said tab portion to the interior side of said end panel.

56. A can end of the easy opening type comprising:

a metallic end panel having a preformed dispensing opening; and a tab closing said dispensing opening and adapted to be pushed inwardly so as to open said dispensing opening, said tab including a fastening portion extending to the exterior side of said end panel and rigidly fastened thereto for securing said tab to said end panel when said tab is pushed inwardly while exposing the edge of said end panel at said dispensing opening.

* * * * *

UNITED STATES PATENT AND TRADEMARK OFFICE

CERTIFICATE OF CORRECTION

PATENT NO. : 4,065,025

DATED : December 27, 1977

INVENTOR(S) : Vinson S. Potts

It is certified that error appears in the above-identified patent and that said Letters Patent are hereby corrected as shown below:

Column 1, line 6, delete "1975" and insert --1976--.

Column 3, line 10, delete "at" and insert --as--.

Column 3, line 56, delete "functions" and insert --function--.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*